US009650839B1

(12) United States Patent
Bertagnolli et al.

(10) Patent No.: US 9,650,839 B1
(45) **Date of Patent: *May 16, 2017**

(54) ROTARY DRILL BIT INCLUDING A HEAT-ABSORBING MATERIAL FOR INCREASING THERMAL STABILITY OF A SUPERABRASIVE COMPACT

(71) Applicant: US SYNTHETIC CORPORATION, Orem, UT (US)

(72) Inventors: Kenneth E. Bertagnolli, Riverton, UT (US); Jason Wiggins, Draper, UT (US); Shawn C. Scott, Payson, UT (US)

(73) Assignee: US SYNTHETIC CORPORATION, Orem, UT (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/989,185

(22) Filed: Jan. 6, 2016

Related U.S. Application Data

(63) Continuation of application No. 13/102,383, filed on May 6, 2011, now Pat. No. 9,260,923.

(60) Provisional application No. 61/333,309, filed on May 11, 2010.

(51) Int. Cl.
*E21B 10/573* (2006.01)
*E21B 10/42* (2006.01)

(52) U.S. Cl.
CPC ..... *E21B 10/5735* (2013.01); *E21B 10/42* (2013.01)

(58) Field of Classification Search
CPC ..... C22C 26/00; C22C 29/08; E21B 10/567; E21B 10/5735; E21B 10/46; E21B 10/5673; E21B 10/55; E21B 10/573; E21B 10/42
See application file for complete search history.

(56) References Cited

U.S. PATENT DOCUMENTS

| | | | |
|---|---|---|---|
| 4,268,276 | A | 5/1981 | Bovenkerk |
| 4,406,046 | A | 9/1983 | Adam et al. |
| 4,410,054 | A | 10/1983 | Nagel et al. |
| 4,468,138 | A | 8/1984 | Nagel |
| 4,560,014 | A | 12/1985 | Geczy |
| 4,738,322 | A | 4/1988 | Hall et al. |
| 4,811,801 | A | 3/1989 | Salesky et al. |
| 4,913,247 | A | 4/1990 | Jones |
| 5,016,718 | A | 5/1991 | Tandberg |

(Continued)

OTHER PUBLICATIONS

U.S. Appl. No. 61/333,309, filed May 11, 2010, Bertagnolli et al.

(Continued)

*Primary Examiner* — Wei Wang
(74) *Attorney, Agent, or Firm* — Dorsey & Whitney LLP

(57) ABSTRACT

In an embodiment, a superabrasive compact is disclosed in which a heat-absorbing material having a phase-transition temperature lower than a peak operating temperature of a superabrasive table of the superabrasive compact is positioned in the superabrasive compact. In some embodiments, the heat-absorbing material positioned between the substrate and the superabrasive table. In another embodiment, a rotary drill bit is also disclosed including a bit body and at least one cutting element including a substrate and a superabrasive table bonded to the substrate. At least one heat-absorbing material is positioned within the bit body at least proximate to the at least one cutting element.

18 Claims, 11 Drawing Sheets

(56) References Cited

U.S. PATENT DOCUMENTS

| | | | | |
|---|---|---|---|---|
| 5,092,687 | A | 3/1992 | Hall | |
| 5,120,327 | A | 6/1992 | Dennis | |
| 5,135,061 | A | 8/1992 | Newton, Jr. | |
| 5,154,245 | A | 10/1992 | Waldenström et al. | |
| 5,180,022 | A | 1/1993 | Brady | |
| 5,364,192 | A | 11/1994 | Damm et al. | |
| 5,368,398 | A | 11/1994 | Damm et al. | |
| 5,460,233 | A | 10/1995 | Meany et al. | |
| 5,480,233 | A | 1/1996 | Cunningham | |
| 5,492,188 | A | 2/1996 | Smith et al. | |
| 5,544,713 | A | 8/1996 | Dennis | |
| 6,155,755 | A | 12/2000 | Kanada et al. | |
| 6,655,234 | B2 | 12/2003 | Scott | |
| 6,679,243 | B2 | 1/2004 | Sung | |
| 6,793,681 | B1 | 9/2004 | Pope et al. | |
| 7,493,965 | B1 | 2/2009 | Bertagnolli et al. | |
| 7,842,111 | B1 * | 11/2010 | Sani | F16C 33/26 175/374 |
| 8,020,642 | B2 | 9/2011 | Lancaster et al. | |
| 2008/0230279 | A1 | 9/2008 | Bitler et al. | |
| 2010/0326740 | A1 | 12/2010 | Hall et al. | |

OTHER PUBLICATIONS

U.S. Appl. No. 13/102,383, filed May 6, 2011, Bertagnolli et al.
U.S. Appl. No. 13/102,383, Nov. 1, 2013, Office Action.
U.S. Appl. No. 13/102,383, Feb. 25, 2014, Office Action.
U.S. Appl. No. 13/102,383, Jul. 23, 2014, Office Action.
U.S. Appl. No. 13/102,383, Oct. 7, 2014, Office Action.
U.S. Appl. No. 13/102,383, Jan. 28, 2015, Office Action.
U.S. Appl. No. 13/102,383, Jul. 24, 2015, Office Action.
U.S. Appl. No. 13/102,383, Oct. 8, 2015, Notice of Allowance.

* cited by examiner

ROTARY DRILL BIT INCLUDING A HEAT-ABSORBING MATERIAL FOR INCREASING THERMAL STABILITY OF A SUPERABRASIVE COMPACT

CROSS-REFERENCE TO RELATED APPLICATIONS

This application is a continuation of U.S. patent application Ser. No. 13/102,383 filed on 6 May 2011, which claims priority to U.S. Provisional Application No. 61/333,309 filed on 11 May 2010. The disclosure of each of the foregoing applications is incorporated herein, in its entirety, by this reference.

BACKGROUND

Wear-resistant, superabrasive compacts are utilized in a variety of mechanical applications. For example, polycrystalline diamond compacts ("PDCs") are used in drilling tools (e.g., cutting elements, gage trimmers, etc.), machining equipment, bearing apparatuses, wire-drawing machinery, and in other mechanical apparatuses.

PDCs have found particular utility as superabrasive cutting elements in rotary drill bits, such as roller cone drill bits and fixed cutter drill bits. A PDC cutting element typically includes a superabrasive diamond layer that is also known as a diamond table. The diamond table is formed and bonded to a substrate using an ultra-high pressure, ultra-high temperature ("HPHT") process. The substrate is often brazed or otherwise joined to an attachment member, such as a stud or a cylindrical backing. The substrate is typically made of tungsten or tungsten carbide.

A rotary drill bit typically includes a number of PDC cutting elements affixed to a drill bit body. A stud carrying the PDC may be used as a PDC cutting element when mounted to a bit body of a rotary drill bit by press-fitting, brazing, or otherwise securing the stud into a receptacle formed in the bit body. The PDC cutting element may also be brazed directly into a preformed pocket, socket, or other receptacle formed in the bit body.

Conventional PDCs are normally fabricated by placing a cemented carbide substrate into a container or cartridge with a volume of diamond crystals positioned on a surface of the cemented carbide substrate. A number of such cartridges may be loaded into a HPHT press. The substrates and volume of diamond crystals are then processed under HPHT conditions in the presence of a catalyst material that causes the diamond crystals to bond to one another to form a matrix of bonded diamond crystals defining a diamond table. The catalyst material is often a metal-solvent catalyst, such as cobalt, nickel, iron, or alloys thereof that is used for promoting intergrowth of the diamond crystals.

In one conventional approach, a constituent of the cemented carbide substrate, such as cobalt from a cobalt-cemented tungsten carbide substrate, liquefies and sweeps from a region adjacent to the volume of diamond crystals into interstitial regions between the diamond crystals during the HPHT process. The cobalt acts as a catalyst to promote intergrowth between the diamond crystals, which results in formation of bonded diamond crystals. Often, a solvent catalyst may be mixed with the diamond crystals prior to subjecting the diamond crystals and substrate to the HPHT process.

The solvent catalyst dissolves carbon from the diamond crystals or portions of the diamond crystals that graphitize due to the high temperature being used in the HPHT process.

The solubility of the stable diamond phase in the solvent catalyst is lower than that of the metastable graphite under HPHT conditions. The undersaturated graphite tends to dissolve into solvent catalyst and the supersaturated diamond tends to deposit onto and/or between existing diamond crystals to form diamond-to-diamond bonds. Accordingly, diamond crystals become mutually bonded to form a matrix of polycrystalline diamond ("PCD"), with interstitial regions between the bonded diamond crystals being occupied by the solvent catalyst.

The presence of the solvent catalyst in the diamond table is believed to reduce the thermal stability of the diamond table at elevated temperatures. For example, some of the diamond crystals can undergo a chemical breakdown or back-conversion to graphite via interaction with the solvent catalyst. At extremely high temperatures, portions of diamond crystals may transform to carbon monoxide, carbon dioxide, graphite, or combinations thereof, thus, degrading the mechanical properties of the PDC.

One conventional approach for improving the thermal stability of PDCs is to at least partially remove the solvent catalyst from the PDC by acid leaching. However, removing the solvent catalyst from the PDC can be relatively time consuming for high-volume manufacturing.

SUMMARY

Embodiments of the invention relate to a superabrasive compact and a rotary drill bit including a heat-absorbing material positioned therein that changes phase during use of the superabrasive compact to absorb heat, thereby limiting temperature excursions and enhancing the thermal stability of the superabrasive compact. In an embodiment, a superabrasive compact includes a superabrasive table bonded to a substrate. The substrate at least partially defines a cavity having a heat-absorbing material positioned therein. The heat-absorbing material has a phase-transition temperature less than about 1000° C.

In another embodiment, a superabrasive compact includes a substrate, a superabrasive table bonded to the substrate, and a heat-absorbing material positioned between the substrate and the superabrasive table. The heat-absorbing material has a phase-transition temperature less than about 1000° C.

In a further embodiment, a rotary drill bit includes a bit body configured to engage a subterranean formation and a plurality of cutting elements affixed to the bit body. At least one of the cutting elements may be configured as any of the superabrasive compacts disclosed herein.

In yet another embodiment, a rotary drill bit includes a bit body configured to engage a subterranean formation and a plurality of cutting elements affixed to the bit body. At least one of the cutting elements includes a substrate and a superabrasive table bonded to the substrate. A heat-absorbing material is positioned within the bit body at least proximate to the at least one cutting element. The heat-absorbing material having a phase-transition temperature less than about 1000° C. In some embodiments, the heat-absorbing mass is positioned between the substrate and the drilling body within a mounting recess sized to receive the substrate.

Features from any of the disclosed embodiments may be used in combination with one another, without limitation. In addition, other features and advantages of the present disclosure will become apparent to those of ordinary skill in the art through consideration of the following detailed description and the accompanying drawings.

BRIEF DESCRIPTION OF THE DRAWINGS

The drawings illustrate several embodiments of the invention, wherein identical reference numerals refer to identical elements or features in different views or embodiments shown in the drawings.

DETAILED DESCRIPTION

Embodiments of the invention relate to a superabrasive compact and a rotary drill bit including a heat-absorbing material positioned therein that changes phase during use of the superabrasive compact to absorb heat, thereby limiting temperature excursions and enhancing the thermal stability of the superabrasive compact. For example, the heat-absorbing material may exhibit a phase-transition temperature (e.g., a state change) less than any of the other constituents of the superabrasive compact.

Figure 1:
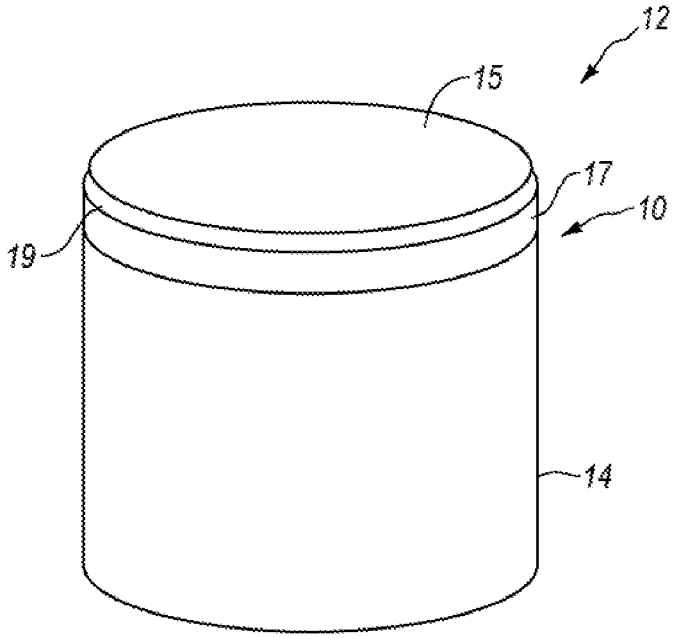
FIG. 1 is an isometric view of a superabrasive compact in accordance to an embodiment of the present invention.

Referring to FIG. 1, a superabrasive compact 10 includes a superabrasive table 12 bonded to a substrate 14. The superabrasive table 12 includes an upper surface 15, at least one lateral surface 17, and an optional chamfer 19 extending therebetween. The upper surface 15, at least one lateral surface 17, optional chamfer 19, or combinations of the foregoing may function as a working/cutting surface when the superabrasive compact 10 is used to cut a subterranean formation. The superabrasive table 12 may be formed of a superabrasive material, such as a PCD comprising a matrix of diamond crystals directly bonded to one another by diamond-to-diamond bonding (e.g., $sp^3$ bonding). In some embodiments, the PCD may be depleted of catalyst material used to catalyze formation of the PCD via acid leaching or another suitable process. For example, the PCD forming the superabrasive table 12 may be at least partially leached to a selected depth from a top and/or side working surface. In other embodiments, the superabrasive table 12 may be formed of a diamond-like material, such as polycrystalline cubic boron nitride ("cBN") or the like.

The substrate 14 may be embodied as a cylindrical metallic substrate or other substrate geometry. In some embodiments, the substrate 14 is a cemented carbide substrate formed of a carbide material. For example, the substrate 14 may include, without limitation, cemented carbides, such as tungsten carbide, titanium carbide, chromium carbide, niobium carbide, tantalum carbide, vanadium carbide, or combinations thereof cemented with a metallic cementing constituent, such as iron, nickel, cobalt, or alloys thereof. In an embodiment, the substrate 14 comprises cobalt-cemented tungsten carbide.

Generally, a heat-absorbing material 22 (see FIGS. 2A and 2B) may be positioned in proximity to or adjacent to the superabrasive table 12 of the superabrasive compact 10. Such a configuration may enable the superabrasive compact 10 to accept a greater amount of thermal energy before failing than a conventional superabrasive compact that does not include the heat-absorbing material. Generally, a heat-absorbing material may be any state, such as a solid, a fluid (e.g., a gas, a liquid, a supercritical fluid, or combinations thereof), or any combination of the foregoing.

Figure 2A:
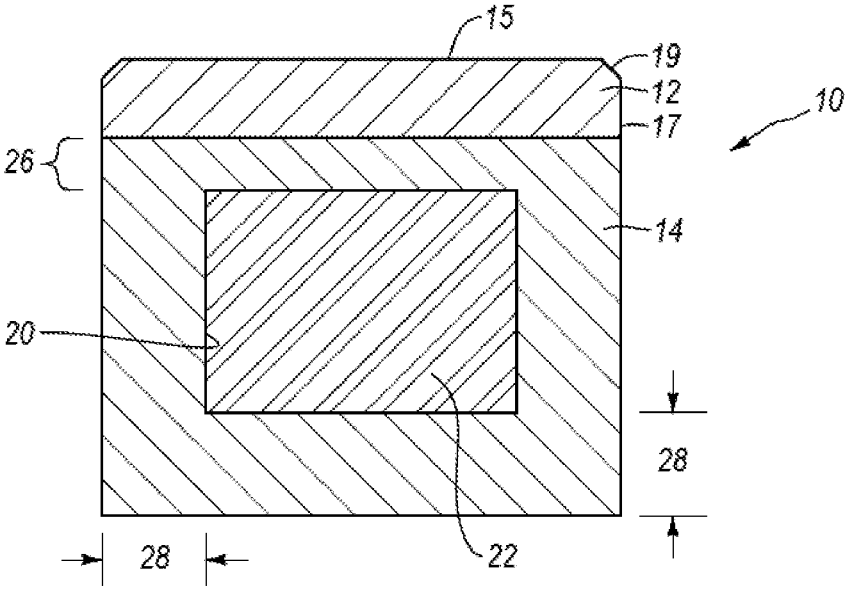
FIGS. 2A and 2B are side cross-sectional views of superabrasive compacts incorporating a heat-absorbing material in accordance with embodiments of the present invention.
Figure 2B:
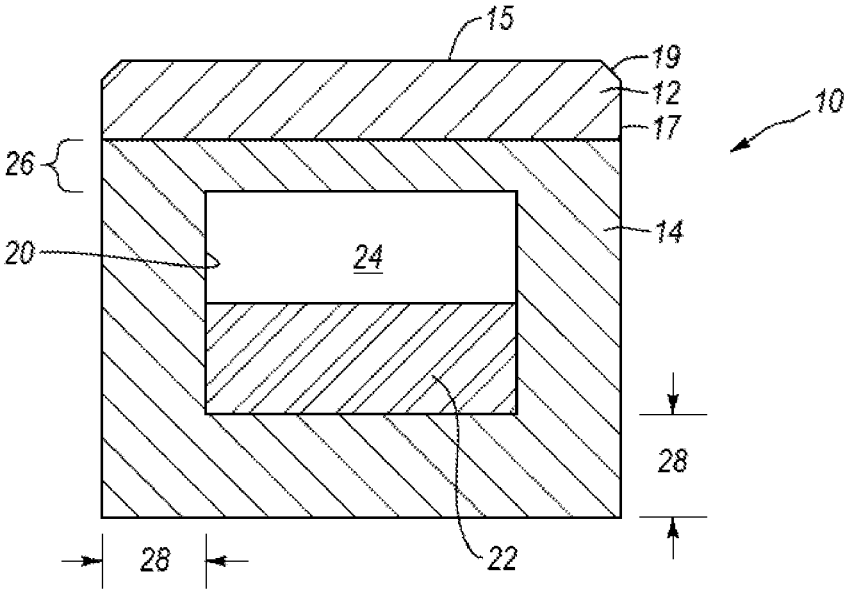

Referring to FIGS. 2A and 2B, the substrate 14 may define a cavity 20 for at least partially receiving a mass of the heat-absorbing material 22. The heat-absorbing material 22 may be a liquid, a solid, or a mixture of liquid and solid. The heat-absorbing material 22 may completely occupy the cavity 20 (FIG. 2A) or may occupy a portion of the cavity 20 with a remaining volume 24 occupied by a gas or vacuum (FIG. 2B) to accommodate expansion of the heat-absorbing material 22. In an embodiment, the substrate 14 has an upper portion 26 between the superabrasive table 12 and the cavity 20 has a thickness chosen to withstand pressures generated from external forces acting on the superabrasive table 12 as well as pressure due to expansion of the heat-absorbing material 22.

In some embodiments, the heat-absorbing material 22 has a phase-transition temperature (e.g., a solid-to-liquid transition temperature (i.e., melting temperature) and/or a liquid-to-gas transition temperature (i.e., vaporization temperature)) within the range of typical operating temperatures of the superabrasive compact 10 when used as a cutting element on a rotary drill bit for drilling a subterranean formation. For example, representative operating temperatures for the superabrasive compact 10 include about 25° C. to 900° C., such as 200° C. to 500° C. or about 250° C. to about 450° C. The foregoing operating temperatures are representative of typical bulk temperatures for the superabrasive compact 10 during cutting operations. The temperature of the cutting tip, edge, or other cutting region of the superabrasive table 12 will be higher than the bulk temperature. The heat of fusion and/or heat of vaporization of the heat-absorbing material 22 enables the superabrasive compact 10 to absorb heat with a reduced increase in temperature due to the endothermic nature of the phase change. For example, the heat-absorbing material 22 melts and/or vaporizes during use of the superabrasive compact 10 to absorb heat that would have increased the temperature of the superabrasive table 12, thereby maintaining the temperature of the superabrasive table 12 at a lower temperature. Consequently, the temperature of the superabrasive table 12 may be maintained at lower temperature than if the heat-absorbing material 22 were absent. Such a configuration may help prevent thermal degradation of the superabrasive table 12.

The upper portion 26 may therefore be sufficiently thick to prevent cracking due to a change in volume of the heat-absorbing material 22 as the heat-absorbing material 22 changes from solid to liquid, or from liquid to gas. Portion 28 of the sides and bottom of the substrate 14 may have a thickness less than the thickness of the upper portion 26 inasmuch as the sides and bottom of the substrate 14 will typically be supported by the body of a drill bit or bearing ring.

Referring to FIGS. 3A-3D, in some embodiments, heat conduction away from the superabrasive table 12 may be aided by a heat pipe 40. The heat pipe 40 may include a wicking portion 42, vapor channel 44, and a vaporizable material 46. The heat pipe 40 may be have a round, square, or other cross-sectional shape that may extend substantially perpendicular to the superabrasive table 12, such that heat will flow away from the superabrasive table 12. The wicking portion 42 extends along the walls of the heat pipe 40. The vapor channel 44 extends through the wicking portion 42 and enables evaporated vaporizable material to migrate to the cooler end of the heat pipe and condense. The heat pipe 40 may be encapsulated and may be positioned at least partially within the substrate 14 and isolated from the superabrasive table 12 by a barrier 47 that is secured to, or monolithically formed with, the substrate 14. In another embodiment, the barrier 47 may be omitted and the superabrasive table 12 may seal one end of the heat pipe 40.

Figure 3A:
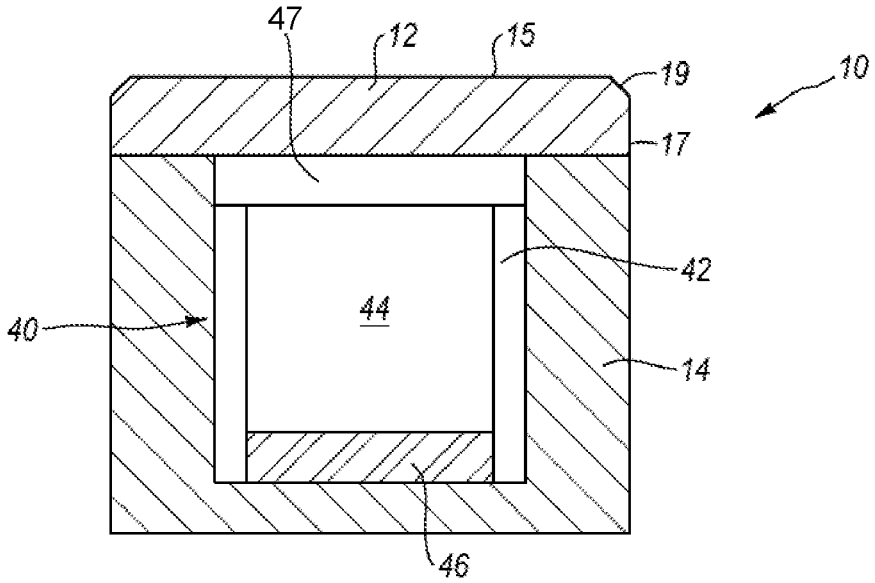
FIGS. 3A-3D are side cross-sectional, top cross-sectional, top cross-sectional, and side cross-sectional views, respectively, of superabrasive compacts incorporating a heat pipe in accordance with embodiments of the present invention.
Figure 3B:
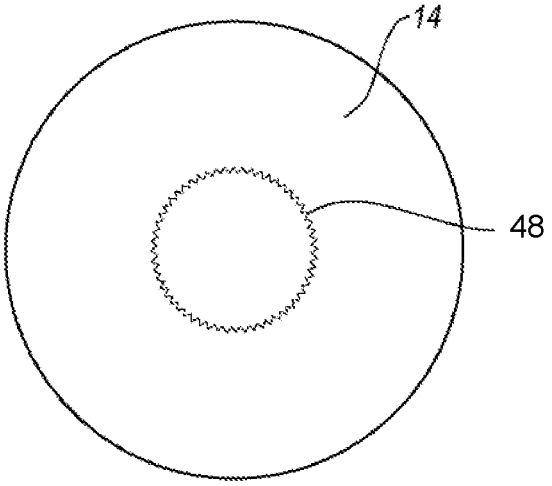
Figure 3C:
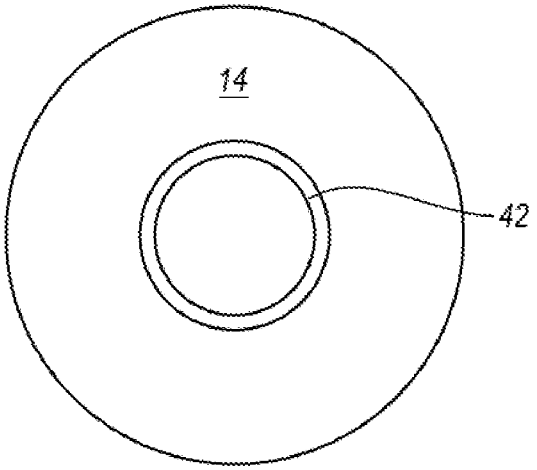

Referring specifically to FIG. 3B, the wicking portion 42 may include grooves 48 formed in the substrate 14, or a tube embedded in the substrate 14, and may be configured to cause capillary forces to draw condensed vaporizable material 44 through the grooves 48 toward the superabrasive table 12. Referring specifically to FIG. 3C, the wicking portion 42 may include a wicking material capable of conducting the condensed vaporizable material 44 toward the superabrasive table 12.

Figure 3D:
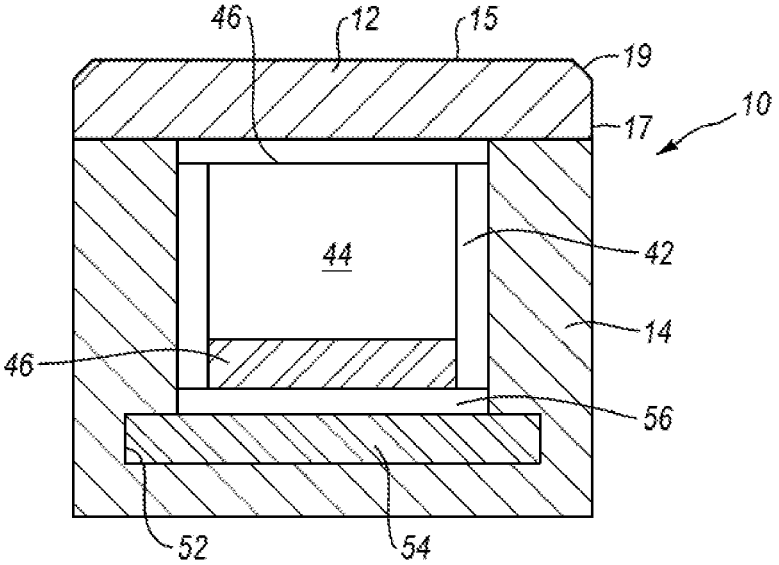

Referring to FIG. 3D, in some embodiments, the heat pipe 40 thermally couples the superabrasive table 12 to a reservoir 52 containing a heat-absorbing material 54. As in the embodiment of FIGS. 2A and 2B, the heat-absorbing material 54 has a phase-transition temperature within the range of typical operating temperatures of the superabrasive compact 10. The heat of fusion and/or heat of vaporization of the heat-absorbing material 54 advantageously enables the superabrasive compact 10 to absorb heat with a reduced increase in temperature of the superabrasive compact 10 due to the endothermic nature of the phase change. The reservoir 52 may be at least partially embedded in the substrate 14 or may be placed in thermal contact with the substrate 14. The heat-absorbing material 54 may be free to migrate into the heat pipe 40 or may be separated therefrom by a barrier, such as a barrier 56 coupled to, or monolithically part of the substrate 14.

Figure 4A:
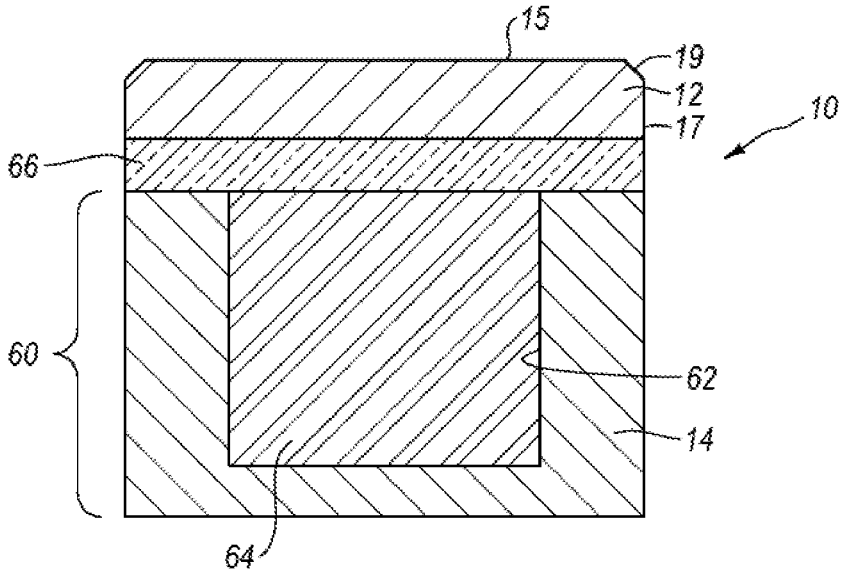
FIGS. 4A-4E are side cross-sectional views of a superabrasive compact including a heat-absorbing material positioned therein in accordance with embodiments of the present invention.
Figure 4B:
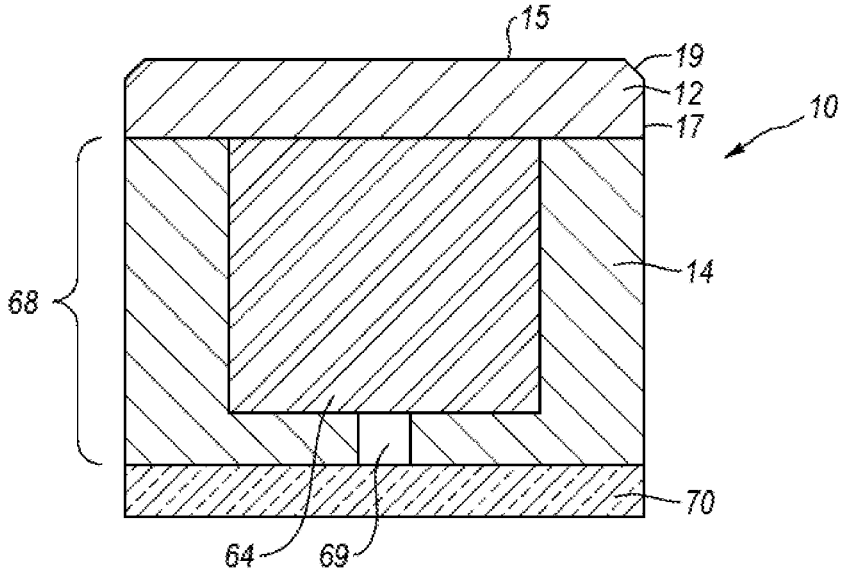

Referring to FIGS. 4A-4E, various techniques may be used to encapsulate a heat pipe and/or a heat-absorbing material undergoing a phase change according to the embodiments of FIGS. 2A-3D. Referring specifically to FIG. 4A, in some embodiments, the substrate 14 may include a lower portion 60 defining a cavity 62, which may be at least partially occupied by heat-absorbing material 64, a heat pipe, or both. A cover 66 is positioned over the cavity and may have an outer diameter substantially identical to the lower portion 60. The superabrasive table 12 may be formed on the cover 66. In some embodiments, an assembly of the lower portion 60, cover 66, and superabrasive particles may undergo an HTHP process to form the superabrasive compact 10 as shown in FIG. 4A. The HTHP process may bond the cover 66 to the lower portion 60 in order to encapsulate the heat-absorbing material 64 and/or heat pipe, in addition to sintering superabrasive particles (e.g., diamond particles) to form the superabrasive table 12 and bond the superabrasive table 12 to the cover 60. Referring to FIG. 4B, in an another embodiment, the cavity 62 may be formed in an upper portion 68 of the substrate 14 and have an opening 69 through a lower surface thereof for receiving the heat-absorbing material 64 and/or heat pipe. In such embodiments, a lower cover 70 may be bonded to the upper portion 68 during an HTHP process, such as the HTHP process during which the superabrasive table 12 is formed and/or the superabrasive table 12 is bonded to the substrate 14.

Figure 4C:
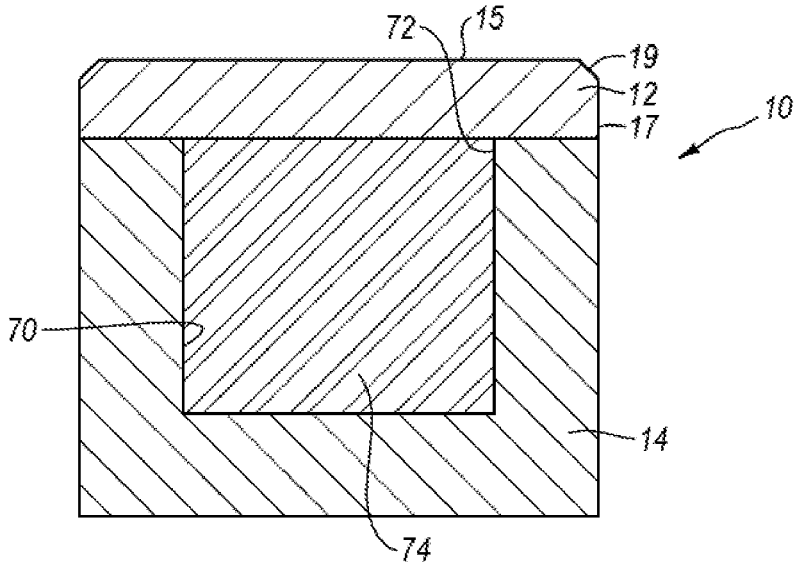
Figure 4D:
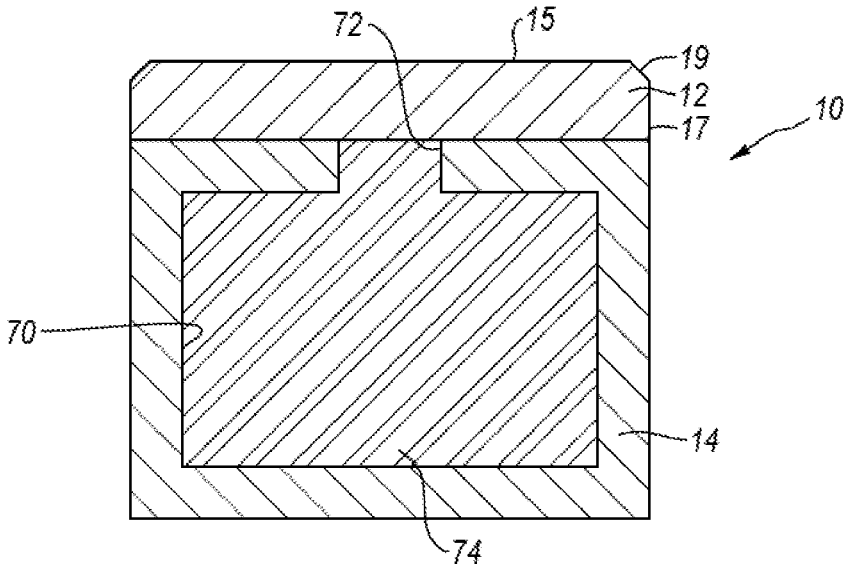
Figure 4E:
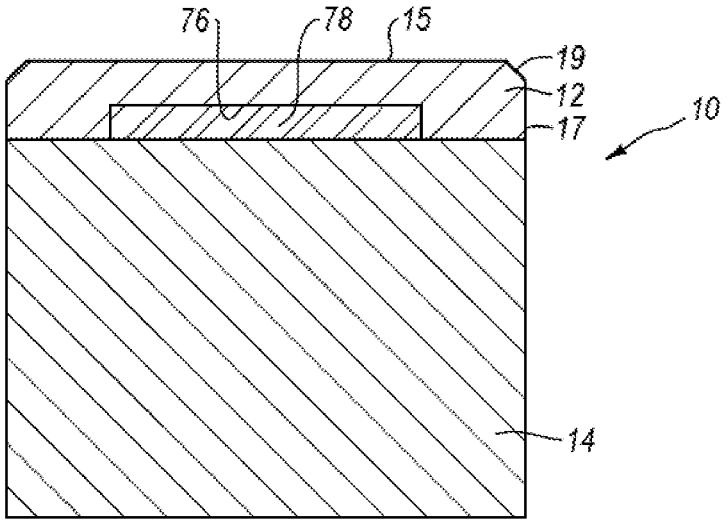

Referring to FIG. 4C-4E, in some embodiments, the superabrasive table 12 in combination with the substrate 14 may retain a heat-absorbing material and/or heat pipe within the substrate 14. In such embodiments, the superabrasive table 12 may be formed by sintering diamond particles in a first HTHP step and subsequently bonding the superabrasive table 12 so-formed to the substrate 14 in a second bonding process (e.g., a brazing process or HPHT bonding process) in order to capture a heat-absorbing material and/or a heat pipe within the substrate 14. In the embodiment of FIG. 4C, a cavity 70 is formed in the substrate 14 having an opening 72 at an upper surface thereof. The superabrasive table 12 is bonded to the substrate 14 over the opening 72 in order to encapsulate a mass of heat-absorbing material 74 and/or a heat pipe within the cavity 70. The superabrasive table 12 may be bonded to the substrate 14 using a second bonding process such as an HTHP bonding process or a brazing process. Referring to FIG. 4D, in some embodiments, the opening 72 may be substantially smaller than a largest diameter of the cavity 70.

Referring to FIG. 4E, in yet another embodiment, a cavity 76 is formed in the superabrasive table 12 and a mass of heat-absorbing material 78 is positioned within the cavity 76 and captured between the superabrasive table 12 and the substrate 14 by bonding the superabrasive table 12 to the substrate 14, such as by an HTHP process or a brazing process.

In other embodiments, the superabrasive table 12 may be configured as an at least partially leached PCD table that is partially or completely infiltrated with any of the disclosed heat-absorbing materials. For example, an assembly including a layer of the heat-absorbing material may be disposed between the at least partially leached PCD table and a cemented carbide substrate. The assembly may be HPHT processed so that the heat-absorbing material infiltrates and occupies at least a portion of the pores or interstitial regions in the at least partially leached PCD table. A metallic cementing constituent from the cemented carbide substrate may partially infiltrate a region of the at least partially leached PCD table adjacent to the cemented carbide substrate, which bonds the infiltrated PCD table to the cemented carbide substrate. In another embodiment, the assembly includes the at least partially leached PCD table disposed between the layer of the heat-absorbing material and the cemented carbide substrate.

Figure 5A:
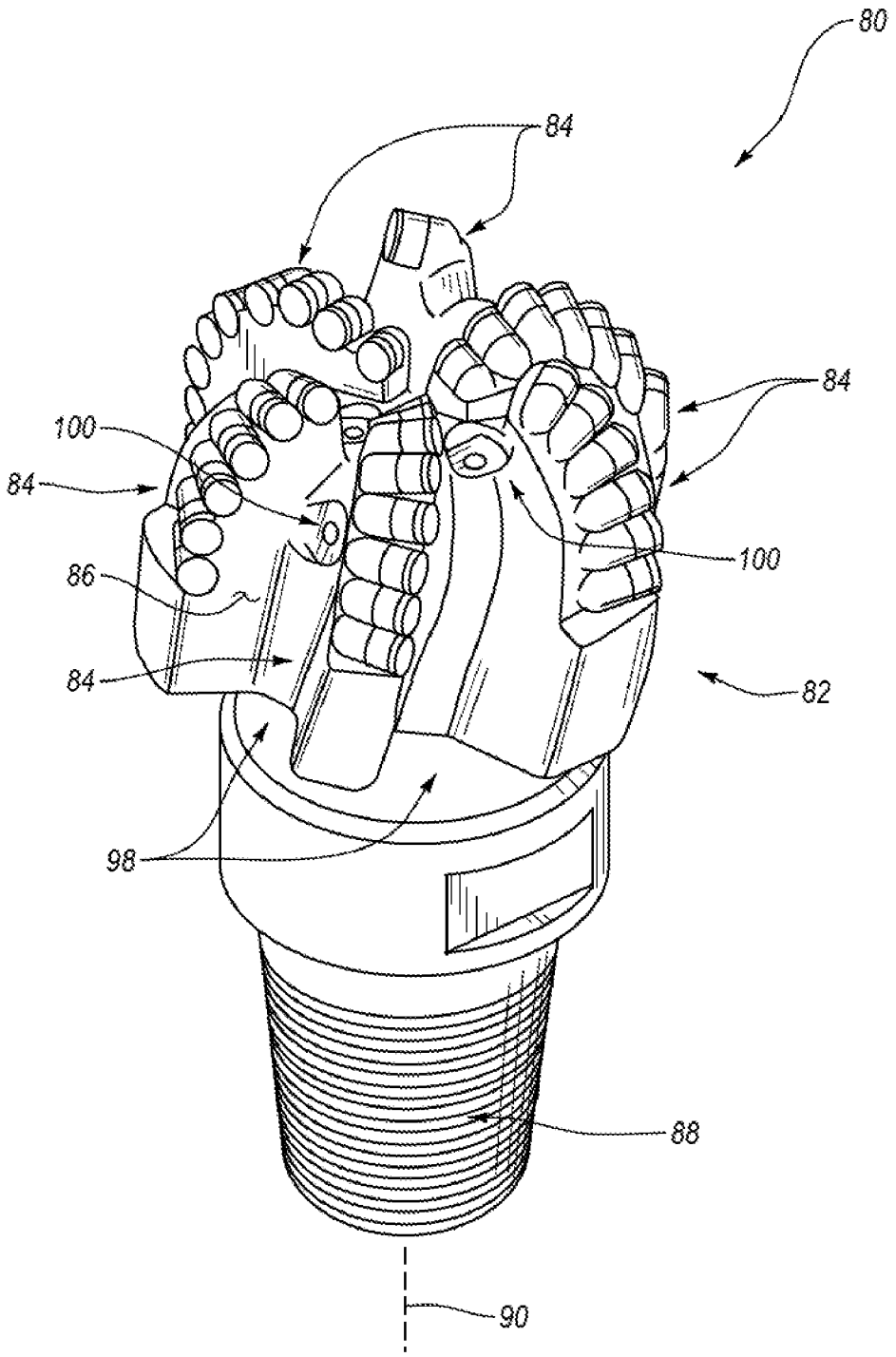
FIGS. 5A and 5B illustrate a drill bit incorporating one or more of the disclosed superabrasive compacts in accordance with embodiments of the present invention.
Figure 5B:
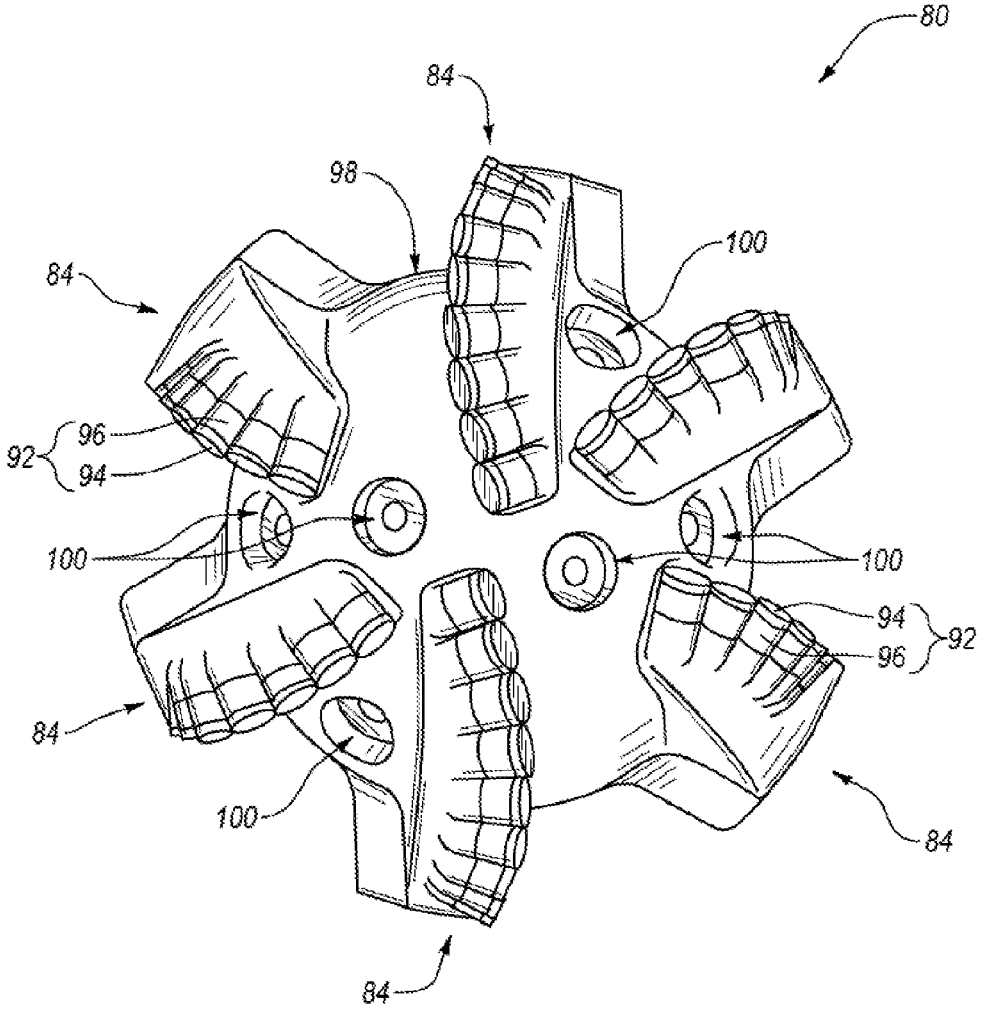

Referring to FIGS. 5A and 5B, a cutting element 92 may comprise a superabrasive compact according to any of the foregoing embodiments may be used in a variety of applications, such as rotary drill bits. FIG. 5A is an isometric view and FIG. 5B is a top elevation view of an embodiment of a rotary drill bit 80. The rotary drill bit 80 includes at least one cutting element 92 comprising a superabrasive compact, such as a PDC, configured according to any of the previously described methods. The rotary drill bit 80 comprises a bit body 82 that includes radially-extending and longitudinally-extending blades 84 with leading faces 86, and a threaded pin connection 88 for connecting the bit body 82 to a drilling string. The bit body 82 defines a leading end structure for drilling into a subterranean formation by rotation about a longitudinal axis 90 and application of weight-on-bit. At least one superabrasive cutting element 92, configured according to any of the previously described superabrasive compact embodiments (e.g., the superabrasive compact shown in FIG. 1), may be affixed to the bit body 82. With reference to FIG. 5B, each of a plurality of cutting elements 92 is secured to the blades 84. For example, each cutting element 82 may include a superabrasive table 84 bonded to a substrate 96. More generally, the cutting elements 92 may comprise any superabrasive compact disclosed herein, without limitation. In addition, if desired, in some embodiments, a number of the cutting elements 92 may be conventional in construction. Also, circumferentially adjacent blades 84 so-called junk slots 98 are defined therebetween, as known in the art. Additionally, the rotary drill bit 80 may include a plurality of nozzle cavities 100 for communicating drilling fluid from the interior of the rotary drill bit 80 to the cutting elements 92.

FIGS. 5A and 5B merely depict one embodiment of a rotary drill bit that employs at least one cutting element that comprises a superabrasive compact suitable for analysis and fabrication in accordance with the disclosed embodiments, without limitation. The rotary drill bit 80 is used to represent any number of earth-boring tools or drilling tools, including, for example, core bits, roller-cone bits, fixed-cutter bits, eccentric bits, bicenter bits, reamers, reamer wings, or any other downhole tool including superabrasive compacts, without limitation.

The superabrasive compacts disclosed herein may also be utilized in applications other than cutting technology. For example, the disclosed superabrasive compacts embodiments may be used in wire dies, bearings, artificial joints, inserts, cutting elements, and heat sinks. Thus, any of the superabrasive compacts disclosed herein may be employed in an article of manufacture including at least one superabrasive element or superabrasive compact.

The embodiments of superabrasive compacts disclosed herein may be used in any apparatus or structure in which at least one conventional superabrasive compact is typically used. In one embodiment, a rotor and a stator, assembled to form a thrust-bearing apparatus, may each include one or more superabrasive compacts configured according to any of the embodiments disclosed herein and may be operably assembled to a downhole drilling assembly. U.S. Pat. Nos. 4,410,054; 4,560,014; 5,364,192; 5,368,398; and 5,480,233, the disclosure of each of which is incorporated herein, in its entirety, by this reference, disclose subterranean drilling systems within which bearing apparatuses utilizing superabrasive compacts disclosed herein may be incorporated. The embodiments of superabrasive compacts disclosed herein may also form all or part of heat sinks, wire dies, bearing elements, cutting elements, cutting inserts (e.g., on a roller-cone-type drill bit), machining inserts, or any other article of manufacture as known in the art. Other examples of articles of manufacture that may use any of the superabrasive compacts disclosed herein are disclosed in U.S. Pat. Nos. 4,811,801; 4,268,276; 4,468,138; 4,738,322; 4,913,247; 5,016,718; 5,092,687; 5,120,327; 5,135,061; 5,154,245; 5,180,022; 5,460,233; 5,544,713; and 6,793,681, the disclosure of each of which is incorporated herein, in its entirety, by this reference.

Figure 6A:
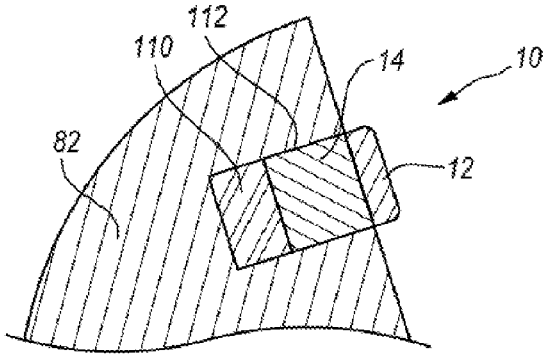
FIGS. 6A-6C are cutaway cross-sectional views a superabrasive compact and heat-absorbing material within a drill bit body to which the superabrasive compact is mounted in accordance with embodiments of the present invention.
Figure 6B:
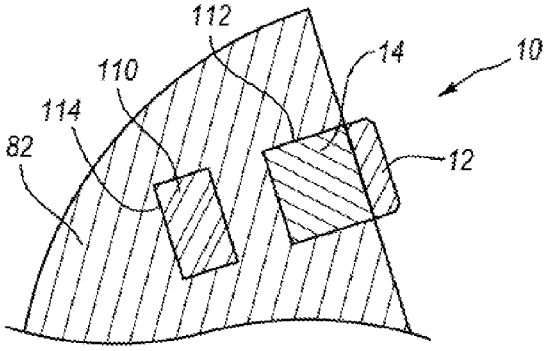
Figure 6C:
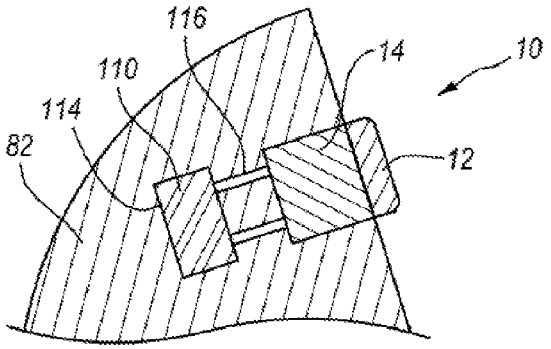

Referring to FIGS. 6A-6C, in some embodiments, a heat-absorbing material 110 may be positioned within the bit body 82 of the drill bit 80 proximate to the superabrasive compacts 10 mounted to the bit body 82. As with other embodiments described herein, the heat-absorbing material 110 has a phase-transition temperature within the range of typical operating temperatures of the superabrasive compact 10. The heat of fusion and/or the heat of vaporization of the heat-absorbing material 110 enables the superabrasive compact 10 to absorb heat with a reduced increase in temperature due to the endothermic nature of the phase change.

Referring to FIG. 6A, in some embodiments, the superabrasive compact 10 may be secured within a pocket or recess 112 defined by the bit body 82 by brazing or some other fastening structure or process. In the embodiment of FIG. 6A, the pocket 112 is larger than required to secure the superabrasive compact 10 and some or all of the volume of the pocket 112 not occupied by the superabrasive compact 10 is completely or partially occupied by the heat-absorbing material 110. Thus, in the illustrated embodiment, securing the superabrasive compact 10 within the pocket captures the heat-absorbing material 110 between the superabrasive compact 10 and the bit body 82. Referring to FIG. 6B, in another embodiment, a cavity 114 is formed in the bit body 82 adjacent to the pocket 112 sufficiently close to be in thermal contact with the superabrasive compact 10 fastened within the pocket 112. For example, the thermal conductivity of material separating the heat-absorbing material 110 from the superabrasive compact 10 may be greater than 50 W/m·K for a given temperature difference between the heat-absorbing material 110 and the superabrasive compact 10, measured in Kelvin (K). The cavity 114 may then be completely or partially filed with the heat-absorbing material 110. Referring to FIG. 6C, in some embodiments, one or more heat pipes 116 couple the heat-absorbing material 110 to the superabrasive compact 10.

Referring generally to the foregoing embodiments of FIGS. 2A-6C, the heat-absorbing material may be selected to extend the life of a superabrasive table of superabrasive compact. For example, the heat-absorbing material may have a phase-transition temperature that is about 120° C. or less than the peak operating temperature of the superabrasive table 12 and/or substrate 14 of the superabrasive compact 10. The peak operating temperature may include a temperature at which at least one of the superabrasive table 12, the substrate 14, or the bond therebetween fails catastrophically such that the superabrasive compact 10 is no longer suitable for use as a bearing, grinding, or cutting tool. In some embodiments, when the superabrasive table 12 is brazed to the substrate 14 with a braze alloy, the heat-absorbing material may have a phase-transition temperature that is about 120° C. or less than the solidus and/or liquidus of the braze alloy. For example, some superabrasive compacts may include a PCD table comprising PCD having interstitial regions occupied by a diamond solvent catalyst, such as cobalt, may begin to degrade at about 750° C. Accordingly, the heat-absorbing material according to the foregoing embodiments may have a phase-transition temperature greater than about 90° C., less than about 1000° C., less than about 750° C., less than about 800° C., about 200° C. to about 800° C., about 400° C. to about 800° C., about 500° C. to about 800° C., or about 330° C. to about 450° C. In a more specific embodiment, the phase-transition temperature is about 50° C. to about 100° C. lower than the peak operating temperature of the superabrasive compact 10, the melting temperature (or boiling point) or range is about 60° C. to about 600° C. (e.g., about 300° C. to about 440° C.), and the heat of fusion (or heat of vaporization) is at least about 20 J/g (e.g., about 20 J/g to about 500 J/g, about 20 J/g to about 300 J/g, or about 50 J/g to about 300 J/g).

Examples of suitable heat-absorbing materials include, but are not limited to, salts, hydroxides, nitrates, silicates, metals, alloys, semiconductors, and any combination of the foregoing heat-absorbing materials. For example, the heat-absorbing material may be selected from zinc chloride; potassium chloride; a mixture of 31.9 weight % zinc chloride and 68.1 weight % potassium chloride (melting point of 235° C./heat of fusion of 198 J/g); sodium nitrate (melting point of 310° C./heat of fusion of 173 J/g); lead (melting point of 327.5° C./heat of fusion of 23.02 J/g) or a lead alloy; potassium nitrate (melting point of 330° C./heat of fusion of 266 J/g); zinc (melting point of 419.5° C./heat of fusion of 112 J/g) or a zinc alloy; a solution of 38.5 weight % magnesium chloride and 61.5 weight % sodium chloride (melting point of 435° C./heat of fusion of 328 J/g); aluminum (melting point of 660° C./heat of fusion of 396.9 J/g) or an aluminum alloy; sodium chloride (melting point of 800° C./heat of fusion of 480 J/g); and any combination of the foregoing heat-absorbing materials. Other materials having a melting temperature below a peak operating temperature of the superabrasive compact 10 and a high heat of fusion may also be used. For example, the heat-absorbing material may be chosen based on having a melting temperature or range within the typical operating temperature range for a superabrasive compact and a relatively high heat of fusion. A more detailed list of suitable heat-absorbing materials for use in the embodiments disclosed herein is listed below in Tables I and II below along with some of their physical properties, such as melting temperature ($T_{m.p.}$), boiling temperature ($T_{b.p.}$), density, heat of fusion ($\Delta H_f$), and heat of vaporization ($\Delta H_v$).

The amount of temperature decrease achieved by the heat-absorbing material may be approximated using the equation:

$$\Delta T = \frac{M_{HA} L_{HA}}{mc},$$

where ΔT is the reduction in temperature, $M_{HA}$ is the mass of the heat-absorbing material, $L_{HA}$ is the heat of fusion (or heat of vaporization) of the heat-absorbing material, m is the mass of the superabrasive compact and c is the specific heat of the superabrasive compact 10. This equation assumes that the superabrasive compact and surrounding material in thermal contact therewith can be approximated by a mass m and that the superabrasive compact is perfectly insulated. It is apparent from this equation that an appropriate mass of heat-absorbing material having a large heat of fusion can significantly reduce the temperature of the superabrasive compact 10 for a given thermal input and thereby may prevent or postpone catastrophic failure of the superabrasive table 12 due to elevated temperature damage.

TABLE I

| Name | Chemical Formula | $T_{m.p.}$ (° C.) | Density (g/cc) | $\Delta H_f$ (J/g) |
|---|---|---|---|---|
| Zinc Chloride + Potassim Chloride | 31.9 wt % $ZnCl_2$ + 68.1 wt % KCl | 235 | 2.28 | 198 |
| Magnesium Chloride + Sodium Chloride | 38.5 wt % $MgCl_2$ + 61.5 wt % NaCl | 435 | 2.23 | 328 |
| Aluminium | Al | 660.32 | 2.7 | 396.9 |
| Antimony (gray) | Sb | 630 | 6.69 | 162.5 |
| Barium Hydroxide | BaO | 407 | 3.743 | 545 |

TABLE I-continued

| Name | Chemical Formula | $T_{m.p.}$ (° C.) | Density (g/cc) | $\Delta H_f$ (J/g) |
|---|---|---|---|---|
| Benzene | $C_6H_6$ | 5.5 | 0.874 | 126.4 |
| Bismuth | Bi | 271 | 9.78 | 54 |
| Cadmium | Cd | 321 | 8.65 | 55 |
| Copper | Cu | 1,084.62 | 8.94 | 208.7 |
| Germanium dioxide | $GeO_2$ | 400 | 4.228 | 353 |
| Gold | Au | 1,064.18 | 19.3 | 63.72 |
| Hexacontane | $CH_3(CH_2)_{58}CH_3$ | 99.3 | 1 | 236 |
| Indium | In | 156 | 7.31 | 28.6 |
| Iron | Fe | 1538 | 7.874 | 247.3 |
| Potassium Nitrate | $KNO_3$ | 330 | 2.11 | 266 |
| Lauric acid | $C_{12}H_{24}O_2$ | 44.2 | 1.007 | 211.6 |
| Lead | Pb | 327.46 | 11.34 | 23.02 |
| Lithium | Li | 180.54 | 0.534 | 432.2 |
| Sodium Silicate Pentahydrate | $Na_2SiO_3$—$5H_2O$ | 48 | 1.45 | 267 |
| Sodium Nitrate | $NaNO_3$ | 310 | 2.257 | 173 |
| p-terphenyl | $C_6H_5C_6H_4C_6H_5$ | 213.9 | 1.234 | 153 |
| Paraffin wax | $C_{25}H_{52}$ | 47-64 | 0.9 | 200-220 |
| Polonium | Po | 254 | 9.196 | 62 |
| Potassium | K | 63.2 | 0.602 | 61.5 |
| Rhenium Heptoxide | $Re_2O_7$ | 327 | 6.103 | 135 |
| Silver | Ag | 961.78 | 10.49 | 104.6 |
| Sodium | Na | 97.8 | 0.971 | 114 |
| Sodium Chloride | NaCl | 800 | 2.17 | 480 |
| Sodium Cyanide | NaCN | 381 | 1.595 | 372 |
| Sodium Hydroxide | NaOH | 64 | 2.13 | 227.6 |
| Sodium Silicate | $Na_2SiO_3$ | 48 | 1.45 | 267 |
| Strontium Nitrate | $Sr(NO_3)_2$ | 570 | 2.98 | 210 |
| Sulfadiazine | $C_{10}H_{10}N_4O_2S$ | 258 | 0.43632 | 170 |
| Thalium | Tl | 304 | 11.85 | 20 |
| Tin (white) | Sn | 231 | 7.365 | 59 |
| Titanium | Ti | 1668 | 4.506 | 295.6 |
| Titanium(IV) Flouride | $TiF_4$ | 377 | 2.798 | 331 |
| Trimethylolethane + Water | 63 wt % TME + 37 wt % $H_2O$ | 29.8 | 1.12 | 218 |
| Water | $H_2O$ | 0 | 1 | 334 |
| Zinc | Zn | 419.53 | 7.14 | 112 |

TABLE II

| Name | Chemical Formula | $T_{b.p.}$ (° C.) | Density (g/cc) | $\Delta H_v$ (J/g) |
|---|---|---|---|---|
| Ammonia | $NH_3$ | −33.34 | 0.86 | 1369.0 |
| benzene | $C_6H_6$ | 80 | 0.8765 | 433.1 |
| Bromine | Br | 58.8 | 3.12 | 193.2 |
| Butane | $C_4H_{10}$ | −0.5 | 2.48 | 320.0 |
| Cadmium | Cd | 767 | 8.65 | 889.6 |
| Cesium | Cs | 944 | 1.93 | 509.7 |
| Ethanol | $C_2H_6O$ | 78.4 | 0.789 | 841.0 |
| Iodine | I | 184.3 | 4.94 | 163.5 |
| Lead | Pb | 1750 | 11.34 | 871.0 |
| Mercury | Hg | 357 | 13.55 | 295.3 |
| Methanol | $CH_4O$ | 64.7 | 0.7918 | 1104.0 |
| Phosphorous | P | 280 | 1.83 | 391.6 |
| Potassium | K | 759 | 0.86 | 2042.8 |
| R134a | $C_2H_2F_4$ | −26.6 | 0.00425 | 215.9 |
| Rubidium | Rb | 688 | 1.532 | 844.9 |
| Selenium | Se | 685 | 4.28 | 333.1 |
| Sodium | Na | 883 | 0.971 | 4217.5 |
| Sulfur | S | 444.6 | 2.07 | 53.6 |
| Toluene | $C_7H_8$ | 110.6 | 0.8669 | 351.0 |
| Turpentine | | 150 | 0.9 | 293.0 |
| Water | $H_2O$ | 100 | 1 | 2257.0 |

Figure 7:
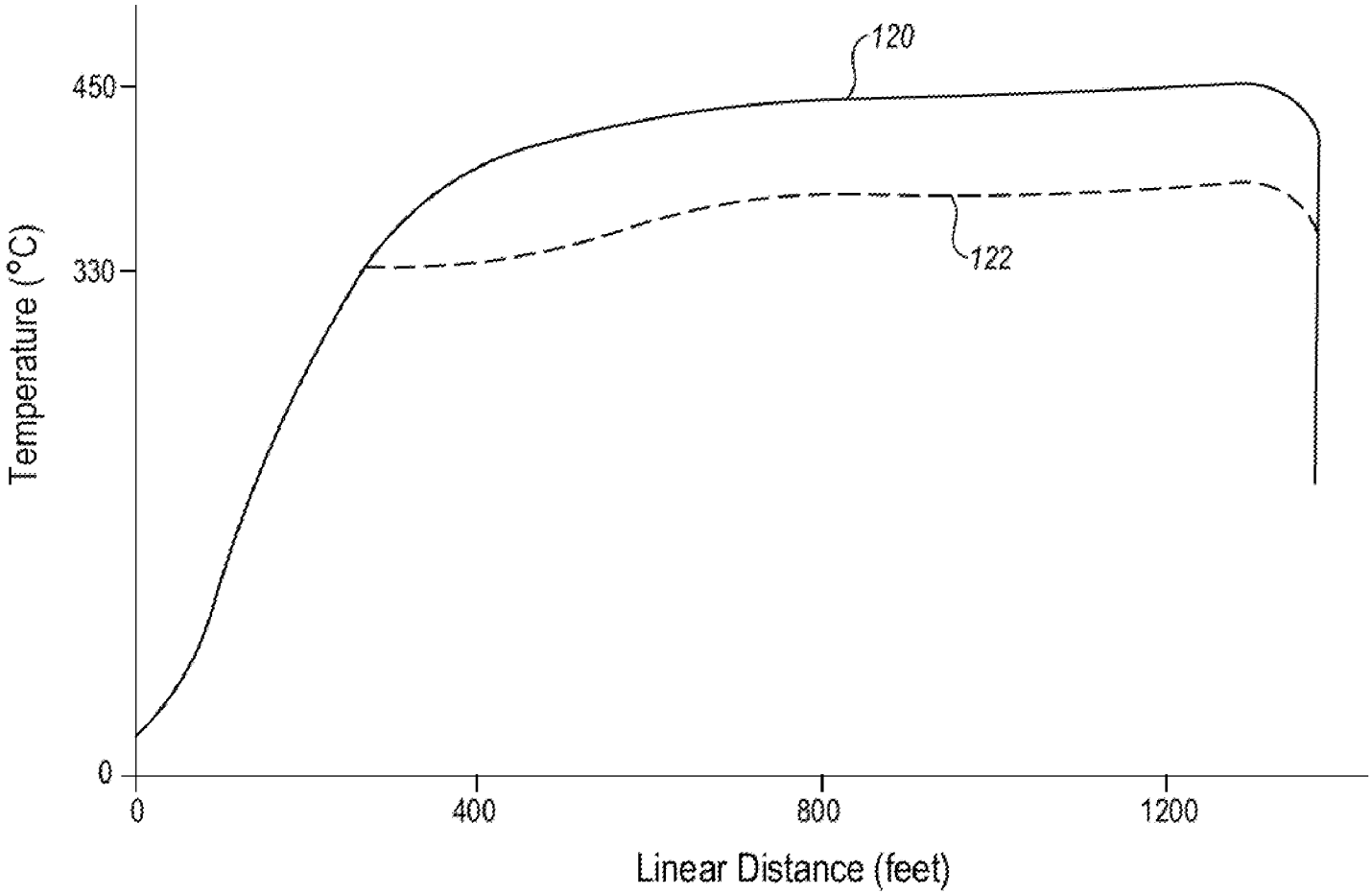
FIG. 7 is a graph illustrating expected performance of a superabrasive compact in thermal contact with heat-absorbing material in accordance with embodiments of the present invention.

FIG. 7 illustrates a plot of the calculated performance of a superabrasive compact 10 in thermal contact with one cubic centimeter of potassium nitrate ($KNO_3$). The horizontal axis represents linear feet of Sierra white granite ground during a vertical turret lathe ("VTL") test. The vertical axis represents temperature of the superabrasive compact under test or computed. Plot line 120 represents actual test data obtained using a superabrasive compact comprising a PCD table bonded a cobalt-cemented tungsten carbide substrate. Plot line 122 represents calculated results for the same superabrasive compact in thermal contact with one cubic centimeter of potassium nitrate. As is apparent from plot line 122, at the melting temperature of potassium nitrate (330° C.), the temperature of the superabrasive compact ceases to rise for number of feet inasmuch as the friction-generated heat is absorbed by the endothermic phase-change of the potassium nitrate. After the potassium nitrate completely melts, the temperature continues to rise with continued grinding until the steady-state operating temperature is reached.

While various aspects and embodiments have been disclosed herein, other aspects and embodiments are contemplated. The various aspects and embodiments disclosed herein are for purposes of illustration and are not intended to be limiting. Additionally, the words "including," "having," and variants thereof (e.g., "includes" and "has") as used herein, including the claims, shall be opened ended and have the same meaning as the word "comprising" and variants thereof (e.g., "comprise" and "comprises").

What is claimed is:

1. A rotary drill bit, comprising:

a bit body configured to engage a subterranean formation;

a plurality of superabrasive cutting elements affixed to the bit body, at least one of the plurality of superabrasive cutting elements including:

a substrate;

a superabrasive table bonded to the substrate; and a heat-absorbing material positioned within a cavity that is at least partially defined by the substrate and completely enclosed by the at least one of the plurality of superabrasive cutting elements, the heat-absorbing material having a phase-transition temperature greater than about 90° C. and less than a temperature at which the at least one of the plurality of superabrasive cutting elements fail.

2. The rotary drill bit of claim 1 wherein the at least one of the plurality of superabrasive cutting elements includes one or more heat pipes embedded therein that thermally couple the superabrasive table and the heat-absorbing material together.

3. The rotary drill bit of claim 2 wherein the one or more heat pipes include a wicking material.

4. The rotary drill bit of claim 1 wherein the cavity is completely enclosed and defined by the substrate and the superabrasive table of the at least one of the plurality of superabrasive cutting elements.

5. The rotary drill bit of claim 1 wherein the cavity is completely enclosed by and defined by the substrate.

6. The rotary drill bit of claim 1 wherein the phase-transition temperature is a liquid-to-gas transition temperature.

7. The rotary drill bit of claim 1 wherein the phase-transition temperature is a solid-to-liquid transition temperature.

8. The rotary drill bit of claim 1 wherein the phase-transition temperature is about 200° C. to about 800° C.

9. The rotary drill bit of claim 1 wherein the at least one of the plurality of superabrasive cutting elements is brazed to the bit body using a braze alloy, the phase-transition temperature of the heat-absorbing material is less than at least one of a solidus or a liquidus of the braze alloy.

10. The rotary drill bit of claim 1 wherein the heat-absorbing material has a heat of fusion of about 20 J/g to about 300 J/g.

11. The rotary drill bit of claim 1 wherein the heat-absorbing material includes at least one material selected from the group consisting of a salt, a hydroxide, a nitrate, a silicate, a metal, an alloy, and a semiconductor.

12. The rotary drill bit of claim 1 wherein the superabrasive table includes polycrystalline diamond.

13. A rotary drill bit, comprising:

a bit body configured to engage a subterranean formation, the bit body defining a plurality of pockets;

a plurality of superabrasive cutting elements, at least one of the plurality of superabrasive cutting elements partially occupying a corresponding one of the plurality of pockets, the at least one of the plurality of superabrasive cutting elements including:

a substrate;

a superabrasive table bonded to the substrate; and a heat-absorbing material embedded therein and being completely enclosed by the at least one of the plurality of superabrasive cutting elements, the heat absorbing material having a phase-transition temperature greater than about 90° C. and less than a temperature at which the at least one of plurality of superabrasive cutting elements fail.

14. The rotary drill bit of claim 13 wherein the phase-transition temperature is a liquid-to-gas transition temperature.

15. The rotary drill bit of claim 13 wherein the phase-transition temperature is a solid-to-liquid transition temperature.

16. The rotary drill bit of claim 13 wherein the phase-transition temperature is about 200° C. to about 800° C.

17. The rotary drill bit of claim 13 wherein the phase-transition temperature is about 400° C. to about 800° C.

18. The rotary drill bit of claim 13 wherein the heat-absorbing material includes at least one material selected from the group consisting of a salt, a hydroxide, a nitrate, a silicate, a metal, an alloy, and a semiconductor.

* * * * *